US009895923B2

(12) United States Patent
Cushing

(10) Patent No.: US 9,895,923 B2
(45) Date of Patent: Feb. 20, 2018

(54) DIVIDER ADHESION STRIP ASSEMBLY

(71) Applicant: CCL Label, Inc., Framingham, MA (US)

(72) Inventor: Eric Cushing, Riverside, CA (US)

(73) Assignee: CCL Label, Inc., Framingham, MA (US)

( * ) Notice: Subject to any disclaimer, the term of this patent is extended or adjusted under 35 U.S.C. 154(b) by 0 days.

(21) Appl. No.: 14/610,019

(22) Filed: Jan. 30, 2015

(65) Prior Publication Data

US 2016/0221381 A1 Aug. 4, 2016

(51) Int. Cl.

| | |
|---|---|
| ***B42F 21/06*** | (2006.01) |
| ***B42F 21/04*** | (2006.01) |
| ***B42F 3/00*** | (2006.01) |
| ***B42D 15/00*** | (2006.01) |
| ***B42F 21/00*** | (2006.01) |

(52) U.S. Cl.

CPC ..... *B42F 21/04* (2013.01); *B42D 15/0073* (2013.01); *B42D 15/0093* (2013.01); *B42F 3/003* (2013.01); *B42F 3/006* (2013.01); *B42F 21/00* (2013.01); *B42F 21/06* (2013.01); *B42P 2241/20* (2013.01)

(58) Field of Classification Search

CPC ..... B42F 3/003; B42F 3/006; B42F 21/06
USPC ..... 402/79; 40/641
See application file for complete search history.

(56) References Cited

U.S. PATENT DOCUMENTS 3,535,804 A * 10/1970 Cunningham ..... B42F 21/00 40/641
RE29,127 E * 2/1977 Janssen ..... B42F 21/00 40/373
4,019,759 A * 4/1977 Stanton ..... B42F 21/04 283/42
4,970,984 A * 11/1990 Vazquez ..... B42F 21/00 40/641
5,236,766 A * 8/1993 Cole ..... B42F 7/00 40/641
5,265,359 A * 11/1993 Glazer ..... G09F 1/12 402/79

(Continued)

FOREIGN PATENT DOCUMENTS

CH 564431 A5 * 7/1975 ..... B42F 21/00
EP 0633131 A1 1/1995

OTHER PUBLICATIONS

ISA / EPO, International Search Report and Written Opinion prepared for PCT/US2016/015509, dated Apr. 11, 2016.

*Primary Examiner* — Kyle Grabowski
(74) *Attorney, Agent, or Firm* — McDonald Hopkins LLC

(57) ABSTRACT

Disclosed is a divider adhesion strip assembly that includes a sheet with a front side and a bottom side having a perimeter that is defined by a first edge, a second edge, a third edge, and a fourth edge wherein the first edge is opposite the second edge and the third edge is opposite the fourth edge. A first laminate strip portion may be adhered to the front side of the divider sheet. The first laminate strip portion is positioned along the first edge of the sheet and extends between the third edge and the fourth edge. A plurality of apertures may be aligned adjacent the second edge of the sheet. A tab member having indicia thereon and an adhesive portion may be provided wherein the adhesive portion is configured to adhere to the first laminate strip portion such that the indicia extends past the perimeter of the sheet.

21 Claims, 5 Drawing Sheets

(56) References Cited

U.S. PATENT DOCUMENTS

| | | | | |
|---|---|---|---|---|
| 6,874,968 | B2 * | 4/2005 | Schwartz | B42F 11/00 402/79 |
| 7,699,349 | B2 * | 4/2010 | MacWilliams | B42F 21/00 40/641 |
| 7,950,175 | B1 * | 5/2011 | Kubusheski | B42F 21/06 40/641 |
| 8,360,675 | B2 * | 1/2013 | Kent | B42F 21/06 402/79 |
| 2003/0168846 | A1 * | 9/2003 | Lebedevski | B42F 3/006 281/2 |
| 2004/0040649 | A1 | 3/2004 | Bratter | |
| 2009/0003923 | A1 * | 1/2009 | Osterheldt | B42F 21/06 283/36 |
| 2010/0293829 | A1 | 11/2010 | Miles et al. | |
| 2014/0339805 | A1 * | 11/2014 | James, Jr. | B42F 3/04 281/27.2 |

* cited by examiner

DIVIDER ADHESION STRIP ASSEMBLY

FIELD OF INVENTION

The present disclosure generally relates to a method and assembly for a divider having an adhesion strip assembly. More particularly, the disclosure relates to divider assembly that includes a laminate strip positioned along at least a portion of the divider sheet.

BACKGROUND

Dividers are well known and are widely used to separate and label various arrangements. When utilizing a bound component, such as a notebook, binder, address book, planner, diary, journal, and the like, it is often desired to mark a location in the bound component for future reference. Dividers are often utilized in binders such as three ring binders or spiral binders and other types of folders or media assemblies. Dividers for organizing sheets of paper or display elements generally include tabs that extend beyond the perimeter of the paper. The dividers separate and visually label various sections of the sheets of paper or display elements to permit prompt access to any one of these sections.

The tabs generally include label indicia thereon to identify a divided section of the sheets of paper or display elements. Other tabs have been known to be formed out of generally clear or semi-transparent material and formed into pockets to insert a label having indicia thereon. Other known dividers have tabs made of clear or transparent material that include labels that may be attached by a pressure sensitive adhesive directly to the tab. Additionally, the tabs may extend continuously from the divider body to allow label indicia to be placed thereon.

However, many known divider systems have inherent deficiencies. For example, there may be a limited area for customizable descriptors on the divider tabs. Further, labels designed to be adhered to the tabs are not easily removed from the tabs. Additionally, many divider systems offer limited range of customizable features.

Therefore, there is a need for expanding the space available for indicia or descriptors associated with a divider to allow for greater customization. There is also a need for an improved divider system that reduces the steps necessary to label or to re-label descriptors associated with divider tabs.

SUMMARY

A divider assembly as shown and described herein. The divider assembly may include a sheet having a front side and an opposite bottom side having a perimeter that is defined by a first edge, a second edge, a third edge, and a fourth edge wherein the first edge is opposite the second edge and the third edge is opposite the fourth edge. A first laminate strip portion may be adhered to the front side of the divider sheet and may be positioned along the first edge of the sheet. The first laminate strip portion may extend between the third edge and the fourth edge. A second laminate strip portion may be adhered to the front side of the divider sheet. The second laminate strip portion may be positioned along the second edge of the sheet and may extend between the third edge and the fourth edge.

The first laminate strip portion may be made of a generally see-through material and the sheet may be made of paper. A plurality of apertures may be aligned along the second laminate strip portion to allow the divider assembly to attach to a binder or folder. A tab member having indicia thereon and an adhesive portion may be provided wherein the adhesive portion of the tab member may be configured to adhere to the first laminate strip portion such that the indicia extends past the perimeter of the sheet. A third laminate strip portion may be adhered to the front side of the sheet, the third laminate strip portion may be positioned along the third edge of the sheet and extend between the first edge and the second edge. A fourth laminate strip portion may be adhered to the front side of the sheet, the fourth laminate strip portion may be positioned along the fourth edge of the sheet and extend between the first edge and the second edge. The sheet may be generally rectangular shaped and the first laminate strip portion may be generally rectangular shaped. A bottom laminate strip portion may be provided on a back side of the sheet. The bottom laminate strip portion may be aligned with the first laminate strip portion along the first edge of the sheet.

In one embodiment, provided is a method of applying tab members to a divider assembly. The method includes the steps of providing a sheet having a front side and an opposite bottom side having a perimeter that may be defined by a first edge, a second edge, a third edge, and a fourth edge wherein the first edge is opposite the second edge and the third edge is opposite the fourth edge. A first laminate strip portion may be applied to the front side of the divider sheet, the first laminate strip portion may be positioned along the first edge of the sheet, the first laminate strip portion may extend between the third edge and the fourth edge. A second laminate strip portion may be applied to the front side of the divider sheet, the second laminate strip portion may be positioned along the second edge of the sheet, the second laminate strip portion may extend between the third edge and the fourth edge. A tab member may be adhered to at least one of the first laminate strip portion and the second laminate strip portion such that a label indicia on a portion of the tab member may extend past the perimeter of the sheet.

In another embodiment, disclosed is a divider assembly including a sheet having a front side and an opposite bottom side having a perimeter that may be defined by a first edge, a second edge, a third edge, and a fourth edge wherein the first edge may be opposite the second edge and the third edge may be opposite the fourth edge. A first laminate strip portion may be adhered to the front side of the divider sheet. The first laminate strip portion may be positioned along the first edge of the sheet and extend between the third edge and the fourth edge. A plurality of apertures may be aligned adjacent the second edge of the sheet. At least one tab member having indicia thereon and an adhesive portion may be provided. The adhesive portion of the tab member may be configured to adhere to the first laminate strip portion such that the indicia extends past the perimeter of the sheet.

BRIEF DESCRIPTION OF THE DRAWINGS

Operation of the disclosure may be better understood by reference to the following detailed description taken in connection with the following illustrations, wherein.

DETAILED DESCRIPTION

Figure 1:
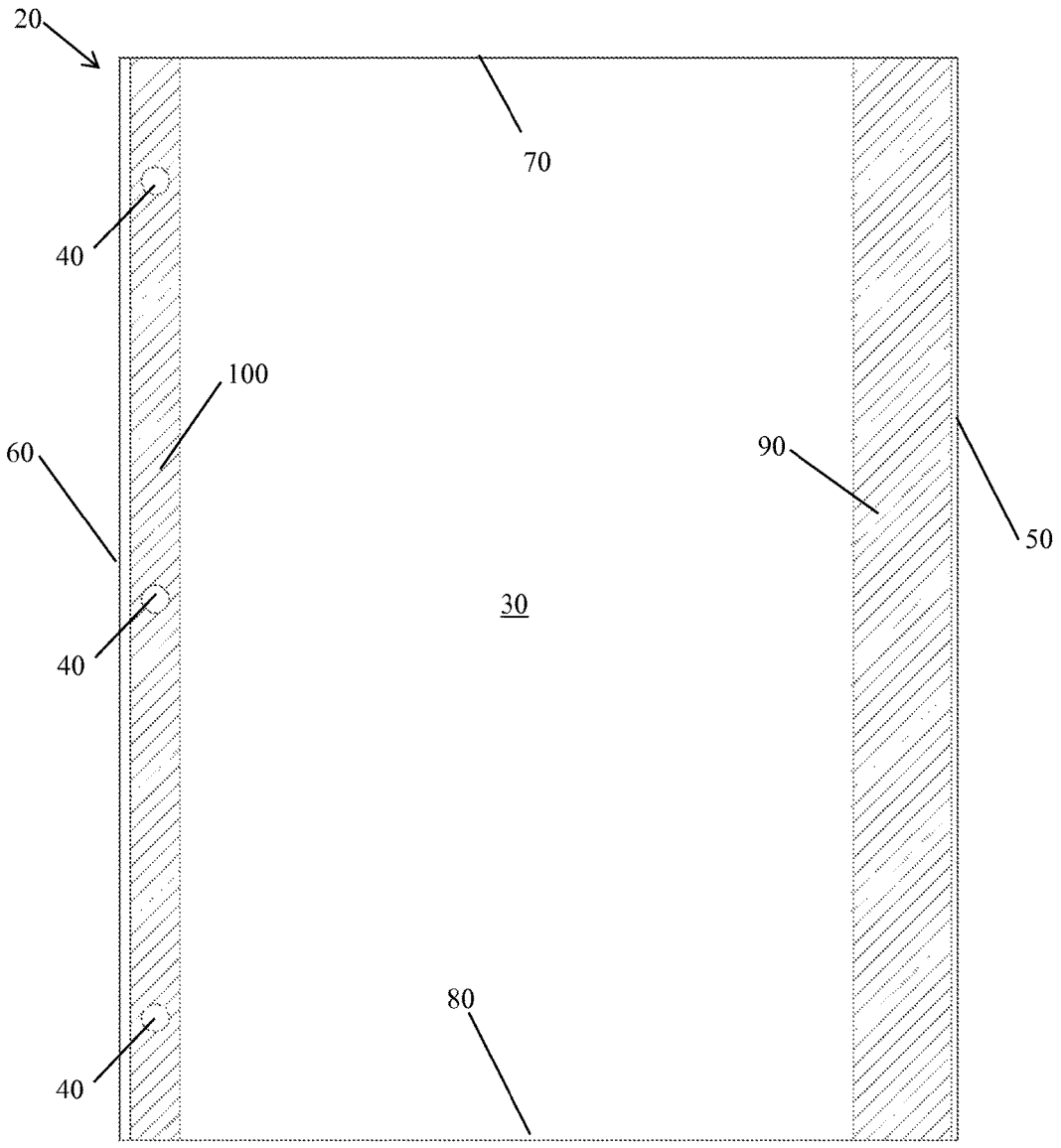
FIG. 1 is a plan view of an embodiment of a divider assembly of the present disclosure.

Reference will now be made in detail to embodiments of the present disclosure, examples of which are illustrated in the accompanying drawings. It is to be understood that other embodiments may be utilized and structural and functional changes may be made without departing from the respective scope of the disclosure. Moreover, features of the various embodiments may be combined or altered without departing from the scope of the disclosure. As such, the following description is presented by way of illustration only and should not limit in any way the various alternatives and modifications that may be made to the illustrated embodiments and still be within the spirit and scope of the disclosure.

A divider assembly 20 having an edge design is disclosed and may be of any appropriate configuration and is not limited to that shown and described herein. It should similarly be understood that the divider assembly 20 may be adapted to divide a plurality of sheets or other display elements of any appropriate size, including, without limitation, 8.5 inches by 11 inches, A4 size, legal size or any other applicable size. The divider assembly 20 may be configured to be utilized with a binder of any appropriate size and construction.

The divider assembly 20 may include a sheet 30 as illustrated by FIGS. 1-4. The sheet 30 may be made of any appropriate material, including, without limitation a paper, cardboard, plastic or polymer material or a transparent, translucent or semi-translucent material. It should be understood that the sheet 30 may be of any appropriate construction and is not limited to that shown and described herein. The sheet 30 may include a front side 32 and an opposite rear side 34. (See FIG. 5) The sheet 30 may also include a first edge 50 opposite a second edge 60 and a top edge 70 opposite a bottom edge 80. The respective edges 50, 60, 70, 80 define a perimeter of the sheet 30. (See FIGS. 1-4)

The sheet 30 may include a first laminate strip portion 90. Further, the sheet may include a second laminate strip portion 100. The first laminate strip portion 90 may be adhered to the sheet 30 and extend along the first edge 50. The first laminate strip portion 90 may extend between the third edge 70 and the fourth edge 80 of the sheet 30. The second laminate strip portion 100 may be adhered to the sheet and extend along the second edge 60. The second laminate strip portion 100 may extend between the third edge 70 and the fourth edge 80 of the sheet 30. The first and second laminate strip portions 90, 100 may extend up to and be against the third edge 70 and the fourth edge 80. Also, there may be a space between the first edge 50 and the first laminate strip portion 90 and there may be a space between the second edge 60 and the second laminate strip portion 100. However, this disclosure is not limiting as the first and second laminate strip portions 90, 100 may extend along and abut up to the first edge 50 and the second edge 60, respectively.

A plurality of apertures 40 may be provided through the sheet 30 and aligned along the second edge 60 thereof. The apertures 40 may be aligned with the second laminate strip 100. The apertures 40 may be configured to receive a ring member from a binder or wire from a spiral notebook to allow the divider assembly 20 to divide a plurality of sheets or other items. The apertures 40 are positioned on the sheet 30 to allow the divider assembly 20 to be operably attached to a binder or folder (not shown), such as a three ring binder. The apertures 40 may be of any configuration. There may be any appropriate number of apertures 40, including, without limitation two, three, four, etc.

Figure 2:
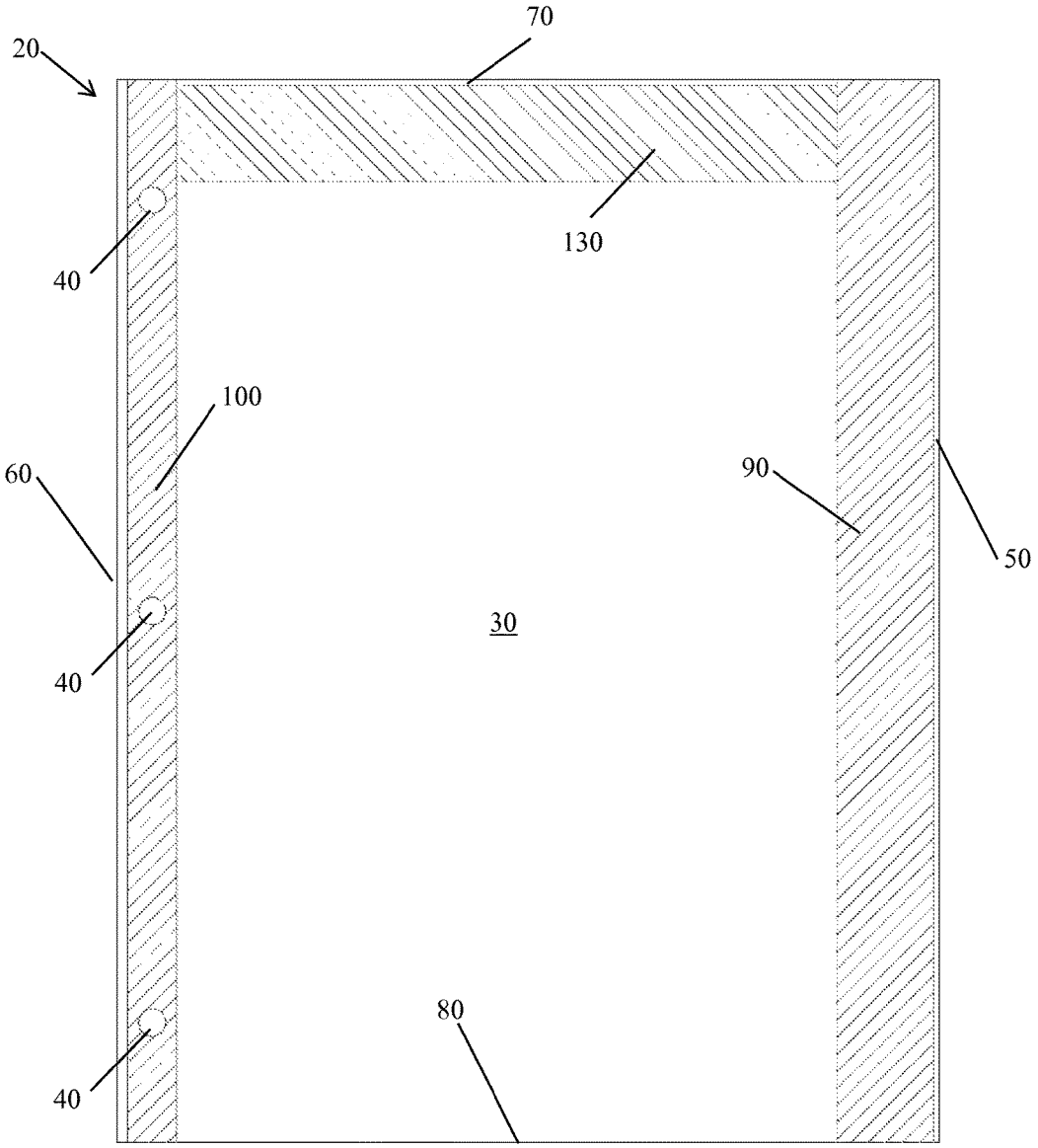
FIG. 2 is a plan view of an embodiment of the divider assembly of the present disclosure.
Figure 3:
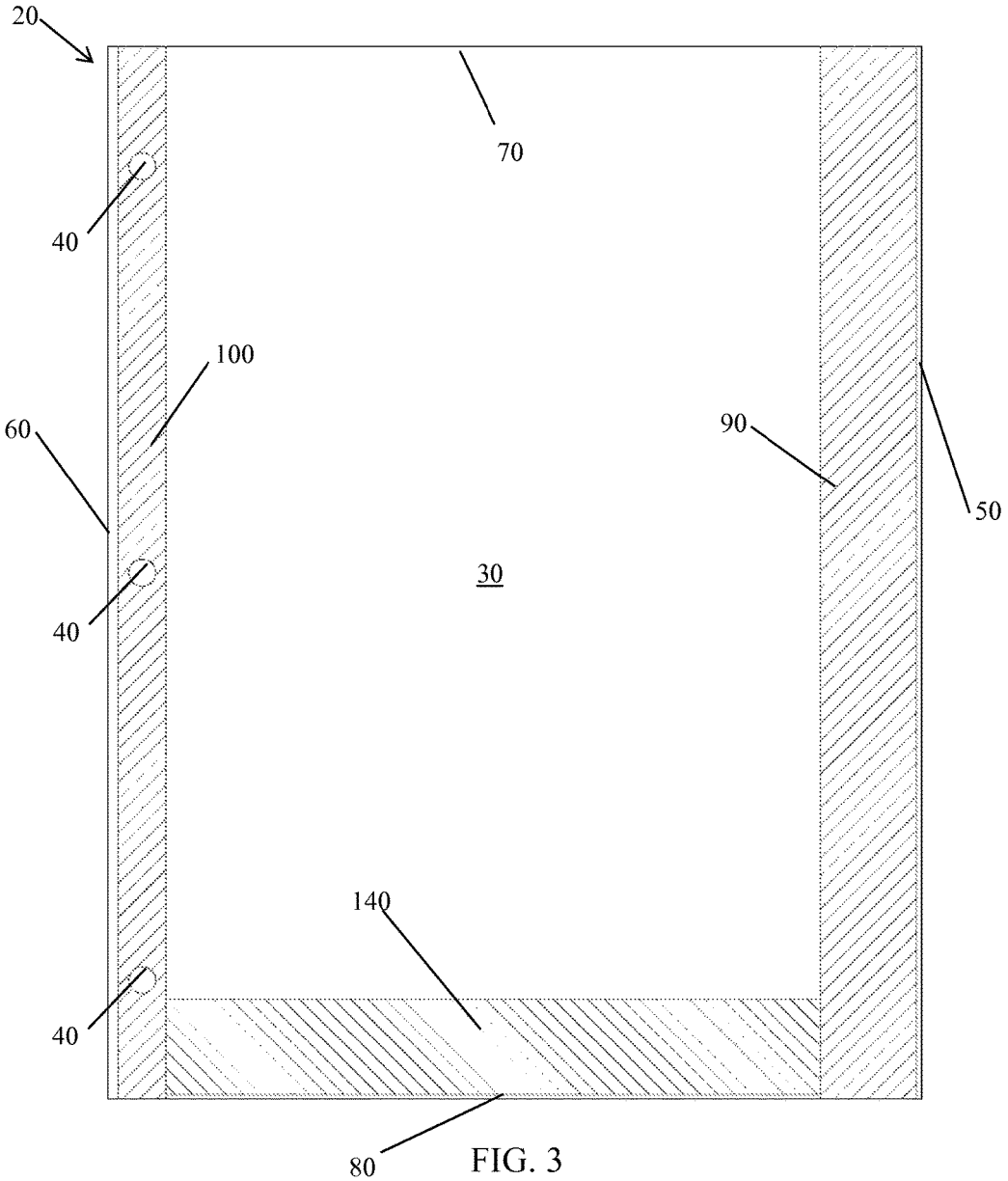
FIG. 3 is a plan view of an embodiment of the divider assembly in accordance with one aspect of the present disclosure.
Figure 4:
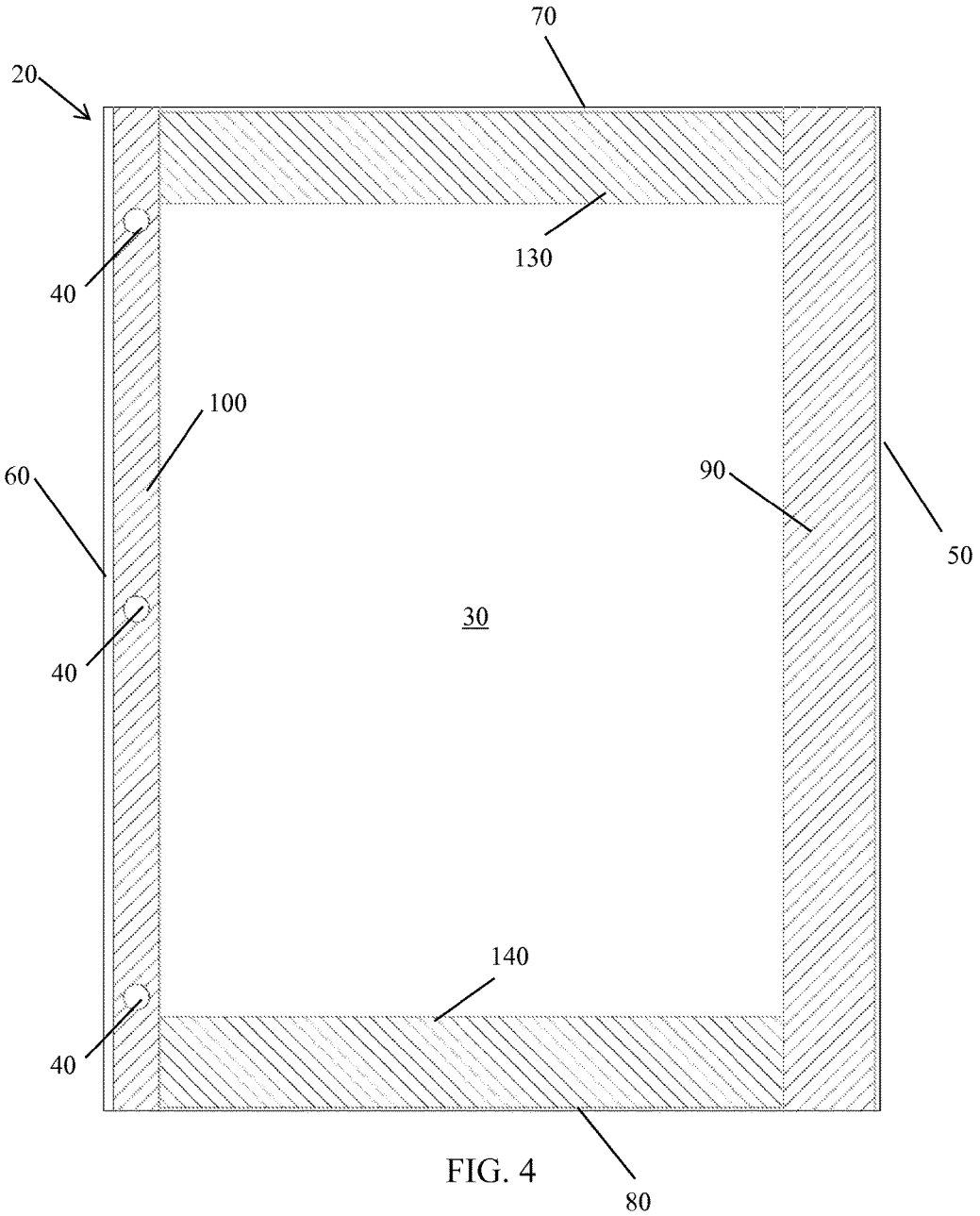
FIG. 4 is a plan view of an embodiment of the divider assembly in accordance with an embodiment of the present disclosure.

Additionally, the sheet 30 may include a third laminate strip portion 130 and a fourth laminate strip portion 140. As illustrated by FIG. 2, the third laminate strip portion 130 may be adhered to the sheet 30 and extend along the third edge 70. The third laminate strip portion 130 may extend between the first edge 50 and the second edge 60 of the sheet 30. As illustrated by FIG. 3, the fourth laminate strip portion 140 may be adhered to the sheet and extend along the fourth edge 80. The fourth laminate strip portion 140 may extend between the first edge 50 and the second edge 60 of the sheet 30. As illustrated by FIG. 4, the sheet 30 may include the first, second, third, and fourth laminate strip portions 90, 100, 130, 140.

The laminate strip portions 90, 100, 130, 140 may be shaped in elongated rectangular strips as illustrated by FIGS. 1-4. However, the laminate strip portions may include various arrangements and geometric configurations and this disclosure is not limited thereto. The laminate strip portions may provide reinforcement to the sheet 30 and may provide a surface along the sheet 30 that may hold an adhesive, such as a removable adhesive, with more reliability, structure and a longer duration than the sheet 30. In particular, if the sheet 30 is made from paper or a polymer such as polypropylene, a removable adhesive that is attached to a tab member such as a sticky note, would not reliably hold its position on the sheet and would likely move or detach after a relatively short period of time.

The laminate strip portions 90, 100, 130, 140 provide an area along or adjacent to the perimeter of the sheet 30 that provide a stronger, more reliable adhesive bond for operable attachment with a tab member with adhesive. In particular, the surface of the laminate strip portion 90, 100, 130, 140 is configured to function well with adhesives to provide a relatively long and strong removable adhesive bond than if the adhesive was applied directly to the sheet 30. The laminate strip portions 90, 100, 130, 140 may be a film material that is clear, colored, or have some kind of design thereon. Variations of the laminate strip portions may include the width of the strip, positioning flush to the edge or with a small gap, positioning exclusively on the back side 34, or positioning on both the front side 32 and the back side 34. Additionally, the laminate strip portions 90, 100, 130, 140 may be made from have the same or different materials or configurations. For example, the laminate strip portions may be made from various polymer materials such as polyethylene terephthalate (PET), polypropylene (PP), polyethylene (PE), or polyvinyl chloride (PVC) type films. Additionally, the laminate strip portions may even be made from a foil type film.

Figure 5:
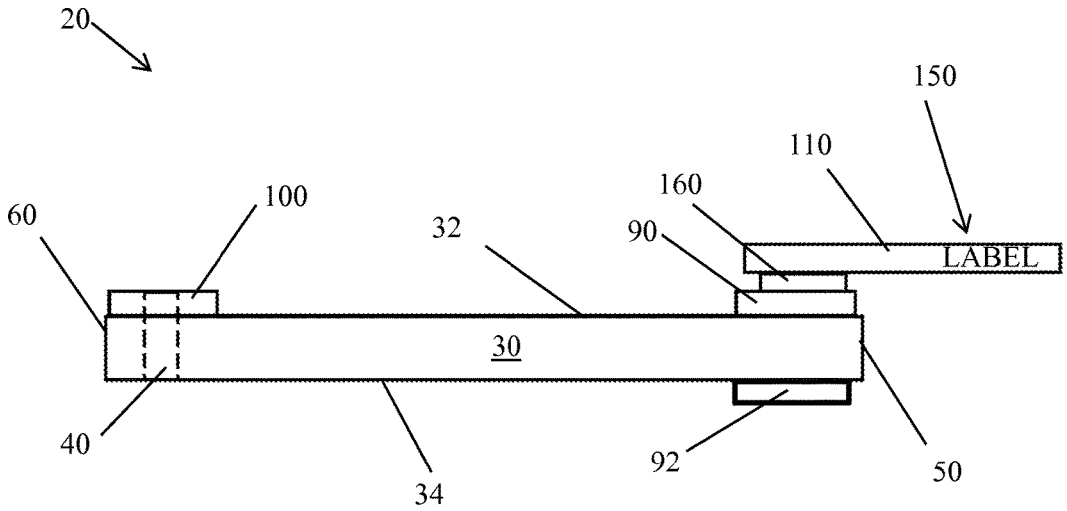
FIG. 5 is a side view of embodiments of the divider assembly with a tab member adhered to a first laminate strip portion in accordance with the present disclosure.

The tab member 110 may include label indicia 150 thereon and may be adhered to the laminate strip portions 90, 100, 130, 140 of the sheet 30. As illustrated by FIG. 5, the tab member 110 may be a piece of paper having indicia 150 placed on either side of the paper and an adhesive portion 160. For example, the tab member 110 may be a sticky note of various sizes and configurations. The adhesive portion 160 may be a removable adhesive configured for multiple uses. The tab members 110 may be made of any appropriate material, including, without limitation, paper, cardboard, or a polymer material such as a polyester material. The tabs may be clear or opaque, colored or colorless, transparent, translucent or semi-translucent material and include various combinations of colors and indicia 150.

The adhesive portion 160 of the tab member 110 may adhere to the laminate strip portion 90. The tab member 110 may be configured to align along the first edge 50 of the sheet 30 wherein a portion of the tab member 110 extends outwardly past the first edge 50 of the sheet 30 to position the indicia 150 of the tab member 110 to be viewable to a user of the divider assembly 20. However, any number of tab members 110 may be provided along the laminate strip portions of the sheet 30 and this disclosure is not limited as to number or type. It is contemplated that a broad range of customizable tab members 110 may be viewable to the user along the first laminate portion 90, the third laminate portion 130, and/or the fourth laminate portion 140 of the sheet 30. The tab members 110 may even be viewable to the user along the second laminate portion 100 having the apertures 40 located thereon. These laminate portions may be considered an adhesive strip that is configured to removably bind well with adhesives provided therein.

The divider assembly may further include at least one sheet 30 and preferably a plurality of sheets 30. In one embodiment, there are five (5) sheets, however this disclosure may include generally any number of sheets, e.g., two, three, four, six, seven, eight, etc. In this embodiment, the sheets 30 may each include a tab member 110 having an outwardly configuration from the first edge 50 of each sheet 30 in a staggered orientation. The tab members 110 may extend from the perimeter of the sheet 30 at a different position along the edges 50, 60, 70, or 80 such that when the plurality of sheets 30 are aligned, the tab members 30 may be off-set in a known manner for easy viewing, access and manipulation of the divider assembly 20.

Although the embodiments of the present invention have been illustrated in the accompanying drawings and described in the foregoing detailed description, it is to be understood that the present invention is not to be limited to just the embodiments disclosed, but that the invention described herein is capable of numerous rearrangements, modifications and substitutions without departing from the scope of the claims hereafter. The features of each embodiment described and shown herein may be combined with the features of the other embodiments described herein. The claims as follows are intended to include all modifications and alterations insofar as they come within the scope of the claims or the equivalent thereof.

Having thus described the invention, I claim:

1. A divider assembly comprising:

a sheet having a front side and an opposite bottom side having a perimeter that is defined by a first edge, a second edge, a third edge, and a fourth edge wherein the first edge is opposite the second edge and the third edge is opposite the fourth edge;

a first laminate strip portion adhered to the front side of the divider sheet, the first laminate strip portion is positioned along the first edge of the sheet, the first laminate strip portion extends up to and against the third edge and the fourth edge along a length of the first edge;

a second laminate strip portion adhered to the front side of the divider sheet, the second laminate strip portion is positioned along the second edge of the sheet, the second laminate strip portion extends between the third edge and the fourth edge; and at least one tab having an adhesive portion, the tab is removably adhered to at least one of the first and second laminate strip portions.

2. The divider assembly according to claim 1, wherein the first laminate strip portion is made of a generally see-through material.

3. The divider assembly according to claim 1, wherein the sheet is made of paper.

4. The divider assembly according to claim 1, wherein a plurality of apertures are aligned along the second laminate strip portion to allow the divider assembly to attach to a binder or folder.

5. The divider assembly according to claim 1, wherein labeling indicia is provided on the at least one tab and wherein the indicia extends past the perimeter of the sheet.

6. The divider assembly according to claim 1, further comprising a third laminate strip portion adhered to at least one of the front side and the bottom side of the sheet, the third laminate strip portion is positioned along the third edge of the sheet, the third laminate strip portion extends between the first edge and the second edge.

7. The divider assembly according to claim 6, further comprising a fourth laminate strip portion adhered to at least one of the front side and the bottom side of the sheet, the fourth laminate strip portion is positioned along the fourth edge of the sheet, the fourth laminate strip portion extends between the first edge and the second edge.

8. The divider assembly according to claim 7, wherein the at least one tab is adhered to at least one of the first, second, third, and fourth laminate strip portions.

9. The divider assembly according to claim 6, wherein the third laminate strip portion is generally rectangular shaped and the fourth laminate strip portion is generally rectangular shaped.

10. The divider assembly according to claim 1, wherein the sheet is generally rectangular shaped.

11. The divider assembly according to claim 1, wherein the first laminate strip portion is generally rectangular shaped.

12. The divider assembly according to claim 1, wherein the second laminate strip portion is generally rectangular shaped.

13. The divider assembly according to claim 1, wherein the first and second laminate strip portions are made from at least one of a polyethylene terephthalate (PET), polypropylene (PP), polyethylene (PE), or polyvinyl chloride (PVC) type films.

14. The divider assembly according to claim 1, wherein a bottom laminate strip portion is provided on the bottom side of the sheet.

15. The divider assembly according to claim 14, wherein the bottom laminate strip portion is aligned with the first laminate strip portion along the first edge of the sheet.

16. A method of applying tab members to a divider assembly, the method comprising:

providing a sheet having a front side and an opposite bottom side having a perimeter that is defined by a first edge, a second edge, a third edge, and a fourth edge wherein the first edge is opposite the second edge and the third edge is opposite the fourth edge;

applying a first laminate strip portion to the front side of the divider sheet, the first laminate strip portion is positioned along the first edge of the sheet, the first laminate strip portion extends up to an against the third edge and the fourth edge along a length of the first edge;

applying a second laminate strip portion to the front side of the divider sheet, the second laminate strip portion is positioned along the second edge of the sheet, the second laminate strip portion extends between the third edge and the fourth edge; and adhering a selectively removable tab member to at least one of the first laminate strip portion and the second laminate strip portion such that a portion of the tab member extends past the perimeter of the sheet.

17. A divider assembly comprising:

a sheet having a front side and an opposite bottom side having a perimeter that is defined by a first edge, a second edge, a third edge, and a fourth edge wherein the first edge is opposite the second edge and the third edge is opposite the fourth edge;

a first laminate strip portion adhered to the front side of the sheet, the first laminate strip portion is positioned along the first edge of the sheet, the first laminate strip portion extends up to an against the third edge and the fourth edge along a length of the first edge;

a plurality of apertures aligned adjacent the second edge of the sheet; and a tab member having an adhesive portion wherein the adhesive portion of the tab member adheres to the first laminate strip portion such that the tab member extends past the perimeter of the sheet.

18. The divider assembly according to claim 17, further comprising a second laminate strip portion adhered to the bottom side of the sheet, the second laminate strip portion is positioned along the first edge of the sheet, the second laminate strip portion extends between the third edge and the fourth edge.

19. The divider assembly according to claim 17, wherein the sheet is generally a rectangle shape.

20. The divider assembly according to claim 17, wherein the first laminate strip is generally a rectangle shape.

21. The divider assembly according to claim 17, wherein a labeling indicia is provided on at least one tab and wherein the indicia extends past the perimeter of the sheet.

* * * * *